US008366555B2

(12) United States Patent
McGahn et al.

(10) Patent No.: US 8,366,555 B2
(45) **Date of Patent: *Feb. 5, 2013**

(54) ROTATING QUICK RELEASE BUTTON PANEL

(75) Inventors: Steven McGahn, Reno, NV (US); Jean Pierre Legras, Washoe Valley, NV (US)

(73) Assignee: IGT, Reno, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/184,337

(22) Filed: Jul. 15, 2011

(65) Prior Publication Data

US 2011/0269553 A1 Nov. 3, 2011

Related U.S. Application Data

(63) Continuation of application No. 11/595,554, filed on Nov. 10, 2006, now Pat. No. 8,012,027.

(51) Int. Cl.
*A63F 9/24* (2006.01)

(52) U.S. Cl. ..... 463/46; 463/29; 463/47

(58) Field of Classification Search ..... 463/16–20, 463/29, 46, 47; 312/220, 222, 295, 309–312, 312/326–329

See application file for complete search history.

(56) References Cited

U.S. PATENT DOCUMENTS 5,813,914 A 9/1998 McKay et al.
6,958,015 B2 10/2005 Luciano, Jr. et al.
6,997,810 B2 2/2006 Cole
2004/0018877 A1 1/2004 Tastad et al.
2005/0026702 A1 2/2005 Cole
2005/0029226 A1 2/2005 Leverich
2005/0032578 A1 2/2005 Cole
2005/0049043 A1 * 3/2005 Crivelli et al. ..... 463/29
2005/0277477 A1 12/2005 Hajder et al.

FOREIGN PATENT DOCUMENTS

WO 2008/060885 5/2008

OTHER PUBLICATIONS

International Search Report and Written Opinion dated Mar. 11, 2008, from Application No. PCT/US2007/083660.
International Preliminary Report on Patentability dated May 12, 2009, from Application No. PCT/US2007/083660.
US Office Action dated Mar. 4, 2009, from U.S. Appl. No. 11/595,554.
US Final Office Action dated Oct. 5, 2009, from U.S. Appl. No. 11/595,554.
US Office Action dated Mar. 28, 2011, from U.S. Appl. No. 11/595,554.
US Notice of Allowance dated Jun. 1, 2011, from U.S. Appl. No. 11/595,554.

* cited by examiner

*Primary Examiner* — Peter DungBa Vo
*Assistant Examiner* — Steve Rowland
(74) *Attorney, Agent, or Firm* — Weaver Austin Villeneuve & Sampson LLP

(57) ABSTRACT

A gaming machine having a support bracket coupled to a cabinet front of the gaming machine, and a modular user interface hingedly coupled to the support bracket with at least one connector, the modular user interface having a button panel and a wrist support, wherein the modular user interface is configured to rotate along an axis of the at least one connector to expose an interior portion of the gaming machine.

20 Claims, 9 Drawing Sheets

ROTATING QUICK RELEASE BUTTON PANEL

CROSS-REFERENCE TO RELATED APPLICATIONS

This application is a continuation of and claims priority to co-pending U.S. patent application Ser. No. 11/595,554, filed on Nov. 10, 2006, entitled "ROTATING QUICK RELEASE BUTTON PANEL," under 35 U.S.C. §119(e) and is incorporated herein by reference in its entirety for all purposes.

FIELD OF THE INVENTION

The present invention relates to a button panel assembly for a gaming machine. More specifically, the present invention relates to a rotating quick release button panel assembly for a gaming machine.

BACKGROUND OF THE INVENTION

Button panel assemblies are used in gaming machines to support a plurality of buttons to receive inputs from a user when playing a game of chance or a wager based game. The button panel assembly supports a plurality of physical buttons and player input switches. In a multi-line video slot machine, for example, the plurality of buttons may include such buttons as pay line selection buttons (e.g., 1 Line, 3 Lines, 5 Lines, 7 Lines, 9 Lines), bet per line buttons (e.g., 1, 2, 3, 4, 5), "cash out" (or "collect"), "call attendant" (or "change"), and the like.

The button panel assembly is attached to the gaming machine door with fasteners, which requires tools to remove for servicing or maintenance. Additionally, the button panel assembly may be integrated with other machine components. Thus, if the button panel assembly is not removed, the button panel assembly can be difficult to access for such maintenance tasks as replacing burned out lamps or defective switches. On the other hand, if the button panel assembly is removed for such purposes as maintenance or replacement, both the button panel assembly and any integral machine components must be removed together even if the machine components do not themselves require maintenance or replacement. The removal of the integral machine components along with the button panel assembly can be burdensome, especially if the machine components are somewhat large and unwieldy. Moreover, if the button panel assembly must be replaced, the integral machine components generally must also be replaced, thereby adding to the cost of a replacement kit.

Furthermore, when the gaming machine door is opened for service or maintenance of components or devices within the interior portion of the gaming machine, the button panel assembly limits the range of movement of the gaming machine door. Namely, the button panel assembly is too wide and abuts the neighboring gaming machine when the gaming machine door is opened. Thus, when the gaming machine door not fully opened, access to the gaming machine cabinet may be limited.

Buttons on the button panel assembly are electrically connected to circuitry within the gaming machine by a plurality of electrical wires. A typical button has at least five wires extending outwardly there from. When manufacturing the button panel assembly, the buttons are individually mounted to the button panel assembly. The electrical wires are then connected to the appropriate buttons and the button panel assembly is then mounted to the gaming machine door. The electrical wires are fed though the interior of the gaming machine and connected to the circuitry.

Unfortunately, when the button panel assembly is mounted to the gaming machine door, there is a significant possibility that one of the many electrical wires may be pinched between the button panel assembly and the gaming machine door. Additionally, it is difficult for a service technician to access any of the button assemblies for maintenance and servicing as the many wires are buried among each other within the gaming machine.

BRIEF DESCRIPTION OF THE INVENTION

The invention provides for a rotating quick release button panel assembly connected to the gaming machine cabinet. The rotatable quick release button panel assembly allows for ease in servicing areas previously difficult to reach.

A gaming machine comprises a support bracket coupled to a cabinet front of the gaming machine, and a modular user interface hingedly coupled to the support bracket with at least one connector, the modular user interface having a button panel and a wrist support, wherein the modular user interface is configured to rotate along an axis of the at least one connector to expose an interior portion of the gaming machine.

Another embodiment of the gaming machine comprises a support bracket coupled to a cabinet front of the gaming machine, and a modular user interface hingedly coupled to the support bracket with at least one connector, wherein the modular user interface is configured to rotate along an axis of the at least one connector to expose an interior portion of the gaming machine, the interior portion of the gaming machine comprising at least one secure area for disposing at least one of a bill validator, a master gaming controller, a printer, or at least one gaming machine electronics.

Yet another embodiment of a gaming machine comprises a support bracket coupled to a cabinet front of the gaming machine, a modular user interface hingedly coupled to the support bracket with at least one connector, and the modular user interface having a button panel and a wrist support, wherein the modular user interface is configured to rotate along an axis of the at least one connector to expose an interior portion of the gaming machine, the interior portion of the gaming machine comprising at least one secure area to dispose at least one of a bill validator, a master gaming controller, a printer, or at least one gaming machine electronics.

A method for accessing an interior portion of a gaming machine comprises actuating a release latch to raise a bracket portion, the bracket portion engaging a secure latch coupled to a modular user interface bottom, disengaging the secure latch to release a modular user interface, the modular user interface having a button panel and wrist support, rotating the modular user interface downwardly, and accessing the interior portion of the gaming machine, the interior portion of the gaming machine comprising at least one secure area to dispose at least one of a bill validator, a master gaming controller, a printer, or at least one gaming machine electronics.

BRIEF DESCRIPTION OF THE DRAWINGS

The accompanying drawings, which are incorporated into and constitute a part of this specification, illustrate one or more embodiments and, together with the detailed description, serve to explain the principles and implementations of the invention.

In the drawings.

DETAILED DESCRIPTION

Embodiments are described herein in the context of a rotating quick release button panel. Those of ordinary skill in the art will realize that the following detailed description is illustrative only and is not intended to be in any way limiting. Other embodiments will readily suggest themselves to such skilled persons having the benefit of this disclosure. Reference will now be made in detail to implementations as illustrated in the accompanying drawings. The same reference indicators will be used throughout the drawings and the following detailed description to refer to the same or like parts.

In the interest of clarity, not all of the routine features of the implementations described herein are shown and described. It will, of course, be appreciated that in the development of any such actual implementation, numerous implementation-specific decisions must be made in order to achieve the developer's specific goals, such as compliance with application- and business-related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

The invention provides for a rotating quick release button panel assembly or modular user interface connected to the gaming machine cabinet and not the gaming machine door. The rotatable quick release button panel assembly allows for ease in servicing areas previously difficult to reach such as the switches, buttons, and electromechanical connections. The button panel assembly may also be used as a security barrier to the interior portion of the gaming machine cabinet.

Figure 1:
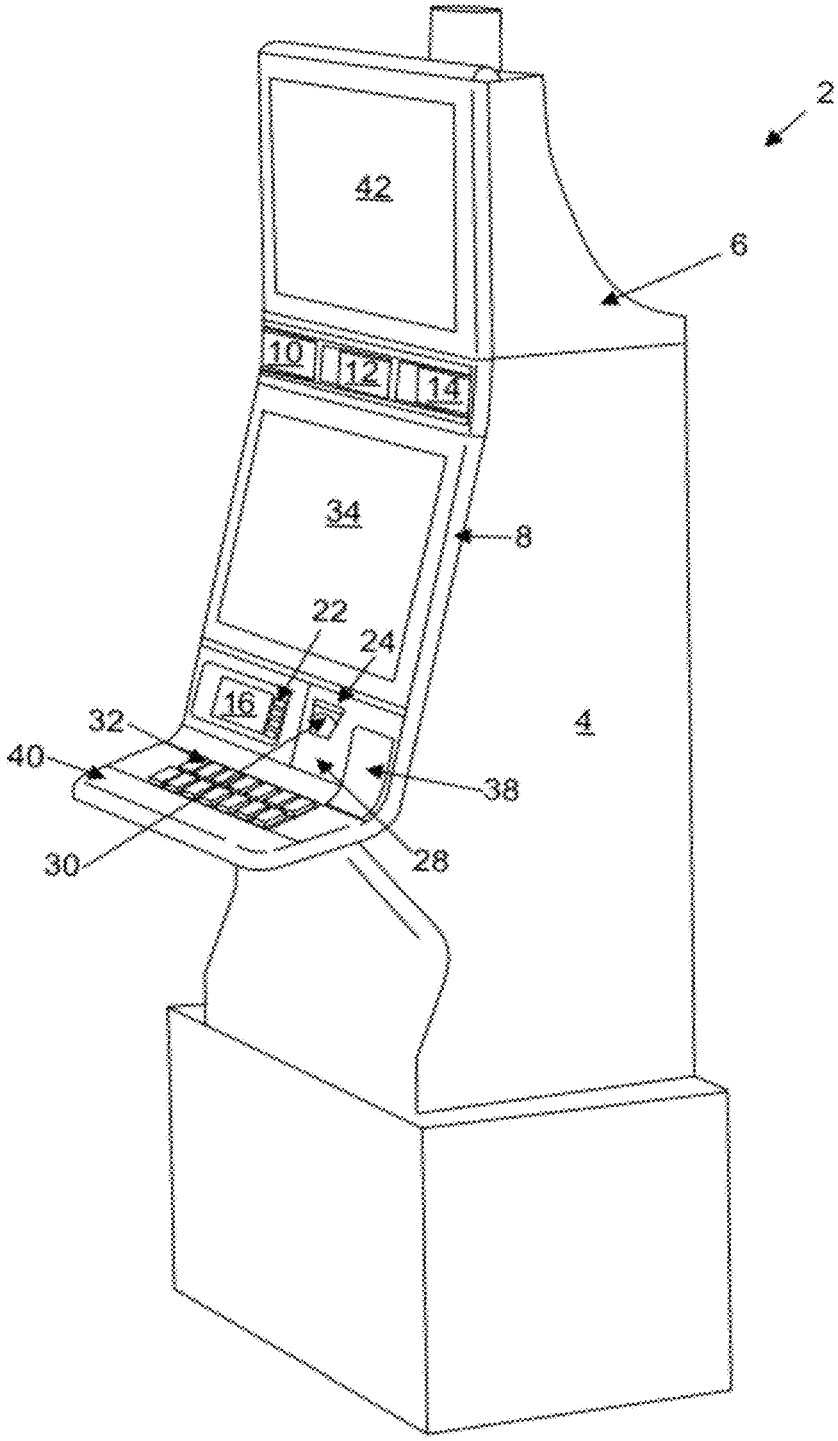
FIG. 1 illustrates an embodiment of a gaming machine.

FIG. 1 illustrates an embodiment of a gaming machine. Gaming machine 2 includes a main cabinet 4, which generally surrounds the machine interior and is viewable by users. The main cabinet includes a main door 8 on the front of the machine, which opens to provide access to the interior portion of the machine. Attached to the main door are player-input switches or buttons 32 on a button panel assembly 40, a coin acceptor 28, a bill validator 30, and a coin tray 38. The main door 8 may also have a ticket printer which prints bar-coded tickets (not shown), a key pad 22 for entering player tracking information, a florescent display 16 for displaying player tracking information, and a card reader 24 for entering a magnetic striped card containing player tracking information. The ticket printer may be used to print tickets for a cashless ticketing system Viewable through the main door 8 is a video display monitor 34. The display monitor 34 will typically be a cathode ray tube, high resolution flat-panel LCD, or other conventional electronically controlled video monitor. The bill validator 30, player-input switches 32, and video display monitor 34 are devices used to play a game on the game machine 2. The devices are controlled by circuitry (e.g. the master gaming controller) housed inside the main cabinet 4 of the machine 2.

Many different types of games, including mechanical slot games, video slot games, video poker, video black jack, video pachinko and lottery, may be provided with gaming machines of this invention. In particular, the gaming machine 2 may be operable to provide a play of many different instances of games of chance. The instances may be differentiated according to themes, sounds, graphics, type of game (e.g., slot game vs. card game), denomination, number of pay lines, maximum jackpot, progressive or non-progressive, bonus games, etc. The gaming machine 2 may be operable to allow a player to select a game of chance to play from a plurality of instances available on the gaming machine. For example, the gaming machine may provide a menu with a list of the instances of games that are available for play on the gaming machine and a player may be able to select from the list a first instance of a game of chance that they wish to play.

The various instances of games available for play on the gaming machine 2 may be stored as game software on a mass storage device in the gaming machine or may be generated on a remote gaming device but then displayed on the gaming machine. The gaming machine 2 may executed game software, such as but not limited to video streaming software that allows the game to be displayed on the gaming machine. When an instance is stored on the gaming machine 2, it may be loaded from the mass storage device into a RAM for execution. In some cases, after a selection of an instance, the game software that allows the selected instance to be generated may be downloaded from a remote gaming device, such as another gaming machine.

The gaming machine 2 includes a top box 6, which sits on top of the main cabinet 4. The top box 6 houses a number of devices, which may be used to add features to a game being played on the gaming machine 2, including speakers 10, 12, 14 and a video display screen 42. Further, the top box 6 may house different or additional devices than shown in FIG. 1. For example, the top box may contain a bonus wheel or a back-lit silk screened panel that may be used to add bonus features to the game being played on the gaming machine. As another example, the top box may contain a display for a progressive jackpot offered on the gaming machine. During a game, these devices are controlled and powered, in part, by circuitry (e.g. a master gaming controller) housed within the main cabinet 4 of the machine 2.

Understand that gaming machine 2 is but one example from a wide range of gaming machine designs on which the present invention may be implemented. For example, not all suitable gaming machines have top boxes or player tracking features. Further, some gaming machines have only a single game display—mechanical or video, while others are designed for bar tables and have displays that face upwards. As another example, a game may be generated in a host computer and may be displayed on a remote terminal or a remote gaming device. The remote gaming device may be connected to the host computer via a network of some type such as a local area network, a wide area network, an intranet or the Internet. The remote gaming device may be a portable gaming device such as but not limited to a cell phone, a personal digital assistant, and a wireless game player. Images rendered from 3-D gaming environments may be displayed on portable gaming devices that are used to play a game of chance. Further a gaming machine or server may include gaming logic for commanding a remote gaming device to render an image from a virtual camera in a 3-D gaming environments stored on the remote gaming device and to display the rendered image on a display located on the remote gaming device. Thus, those of skill in the art will understand that the present invention, as described below, can be deployed on most any gaming machine now available or hereafter developed.

When a user wishes to play the gaming machine 2, he or she inserts cash through the coin acceptor 28 or bill validator 30. Additionally, the bill validator may accept a printed ticket voucher that may be accepted by the bill validator 30 as indicia of credit when a cashless ticketing system is used. At the start of the game, the player may enter playing tracking information using the card reader 24, the keypad 22, and the florescent display 16. Further, other game preferences of the player playing the game may be read from a card inserted into the card reader. During the game, the player views game information using the video display 34. Other game and prize information may also be displayed in the video display screen 42 located in the top box.

During the course of a game, a player may be required to make a number of decisions, which affect the outcome of the game. For example, a player may vary his or her wager on a particular game, select a prize for a particular game selected from a prize server, or make game decisions that affect the outcome of a particular game. The player may make these choices using the player-input switches 32, the video display screen 34 or using some other device which enables a player to input information into the gaming machine. In some embodiments, the player may be able to access various game services such as concierge services and entertainment content services using the video display screen 34 and one more input device.

During certain game events, the gaming machine 2 may display visual and auditory effects that can be perceived by the player. These effects add to the excitement of a game, which makes a player more likely to continue playing. Auditory effects include various sounds that are projected by the speakers 10, 12, 14. Visual effects include flashing lights, strobing lights or other patterns displayed from lights on the gaming machine 2. After the player has completed a game, the player may receive game tokens from the coin tray 38 or the ticket 20 from the printer 18, which may be used for further games or to redeem a prize. Further, the player may receive a ticket 20 for food, merchandise, or games from the printer 18.

Figure 2A:
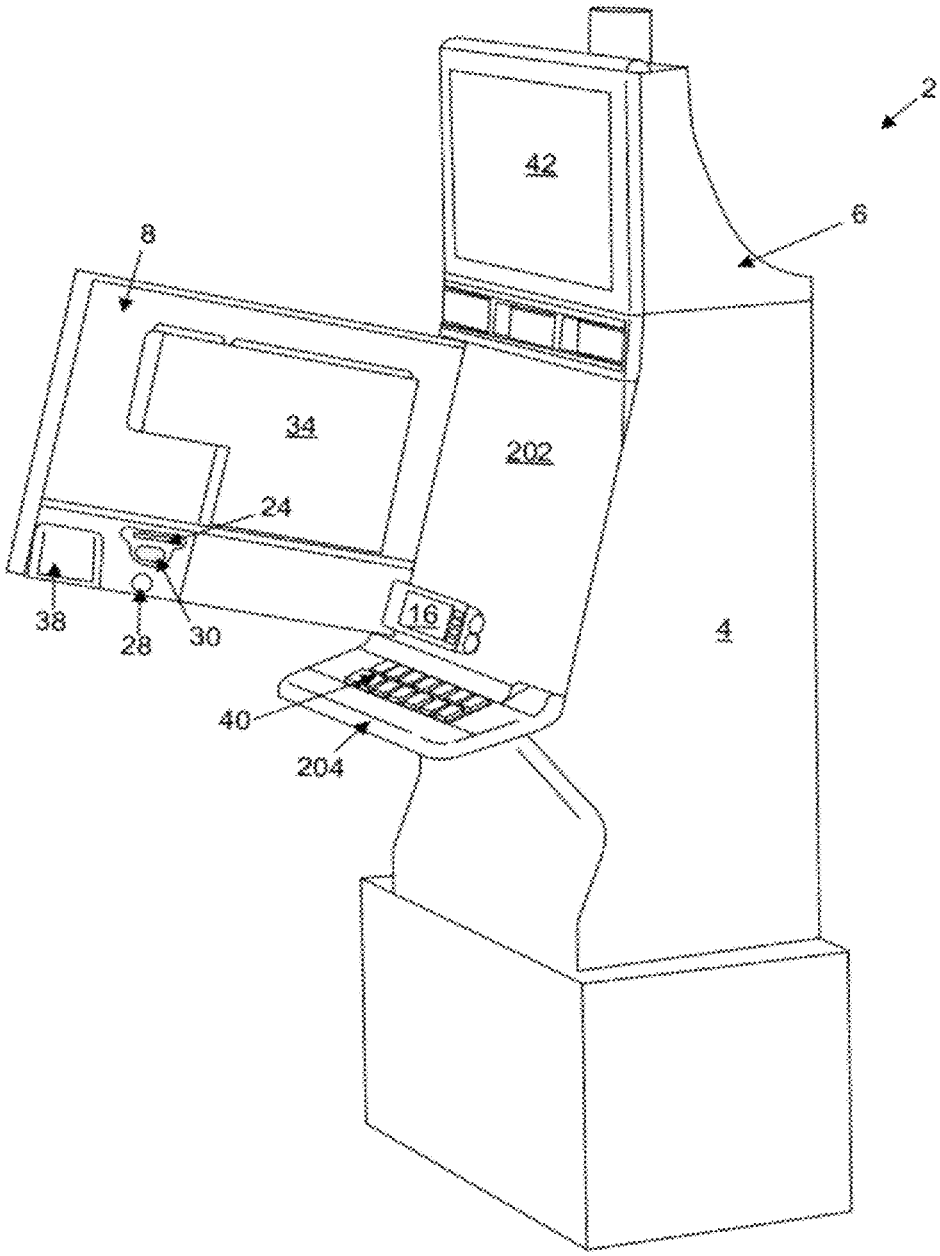
FIGS. 2A, 2B, 2C, and 2D illustrate an embodiment of a rotating quick release modular user interface.

FIGS. 2A, 2B, 2C, and 2D illustrate an embodiment of a rotating quick release modular user interface. FIG. 2A illustrates the gaming machine 2 with the main door 8 in an open position thereby exposing the interior portion 202 of the gaming machine 2. The main door 8 may be secured to the gaming machine 2 by any known secure means such as a door latch. The button panel assembly 40 is illustrated in a closed position. The button panel assembly 40 may be secured by the main door 8 thereby requiring the main door 8 to be open before accessing the button panel assembly 40.

In another embodiment, access to open the main door 8 may be secured using the button panel assembly 40. A locking mechanism (illustrated with reference to FIGS. 3A-3C) may be used to lock and secure the button panel assembly 40 to the gaming machine 2. Once the button panel assembly is moved to an opened position, access to release the door latch to open the main door 8 may be possible. As such, the button panel assembly 40 may be used as a security barrier for access to the cabinet 4.

The button panel assembly 40 may be used to perform other functions, in addition to having a plurality of player-input switches and a plurality of buttons. For exemplary purposes only and not intended to be limiting, the button panel assembly may have a wrist support 204 to allow a user to support his wrists and rest upon. The wrist support may have a width that is substantially the same as a width of the front of the cabinet 4. The button panel assembly may also have a cup holder, a cigarette holder, and other similar devices.

Figure 2B:
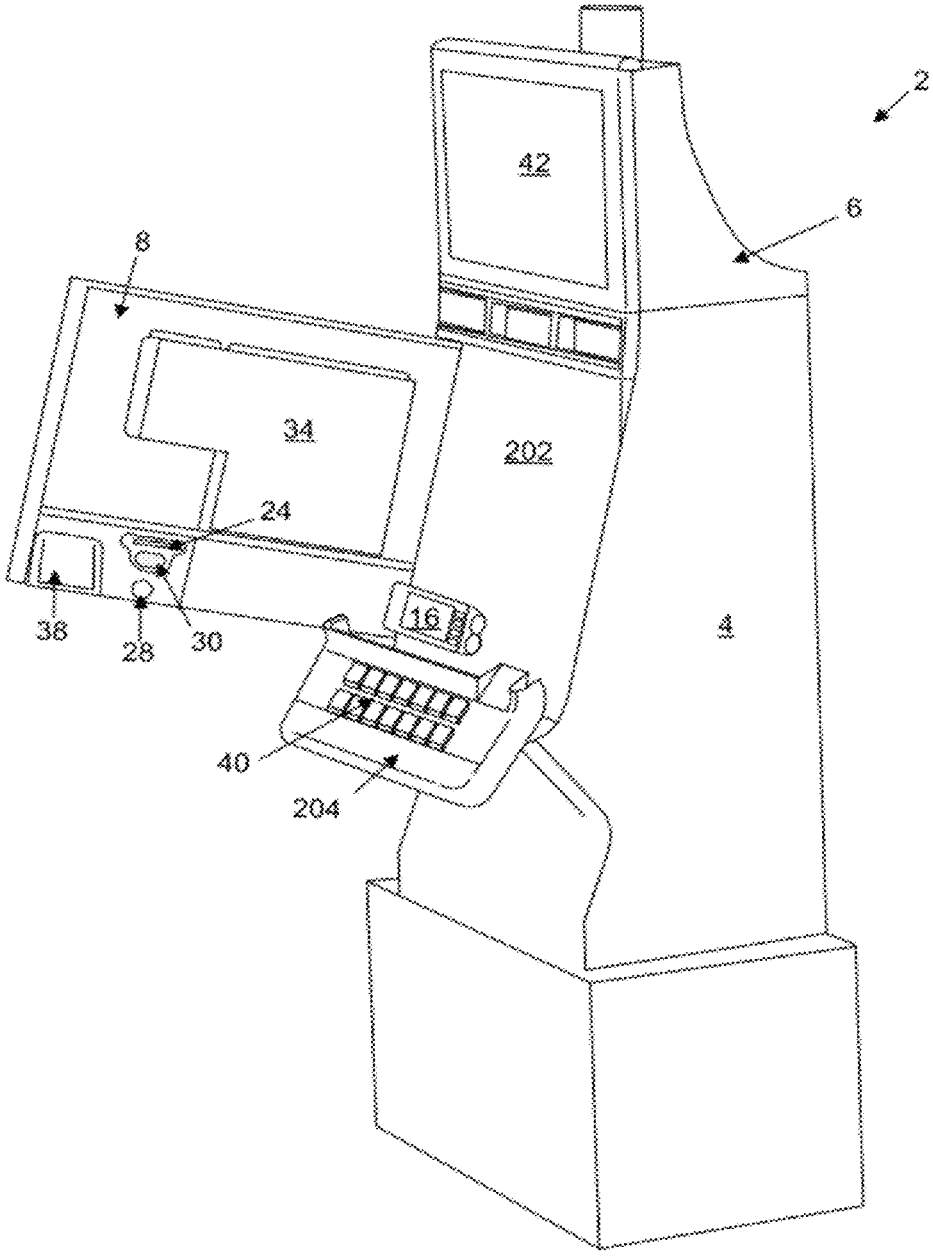
Figure 2C:
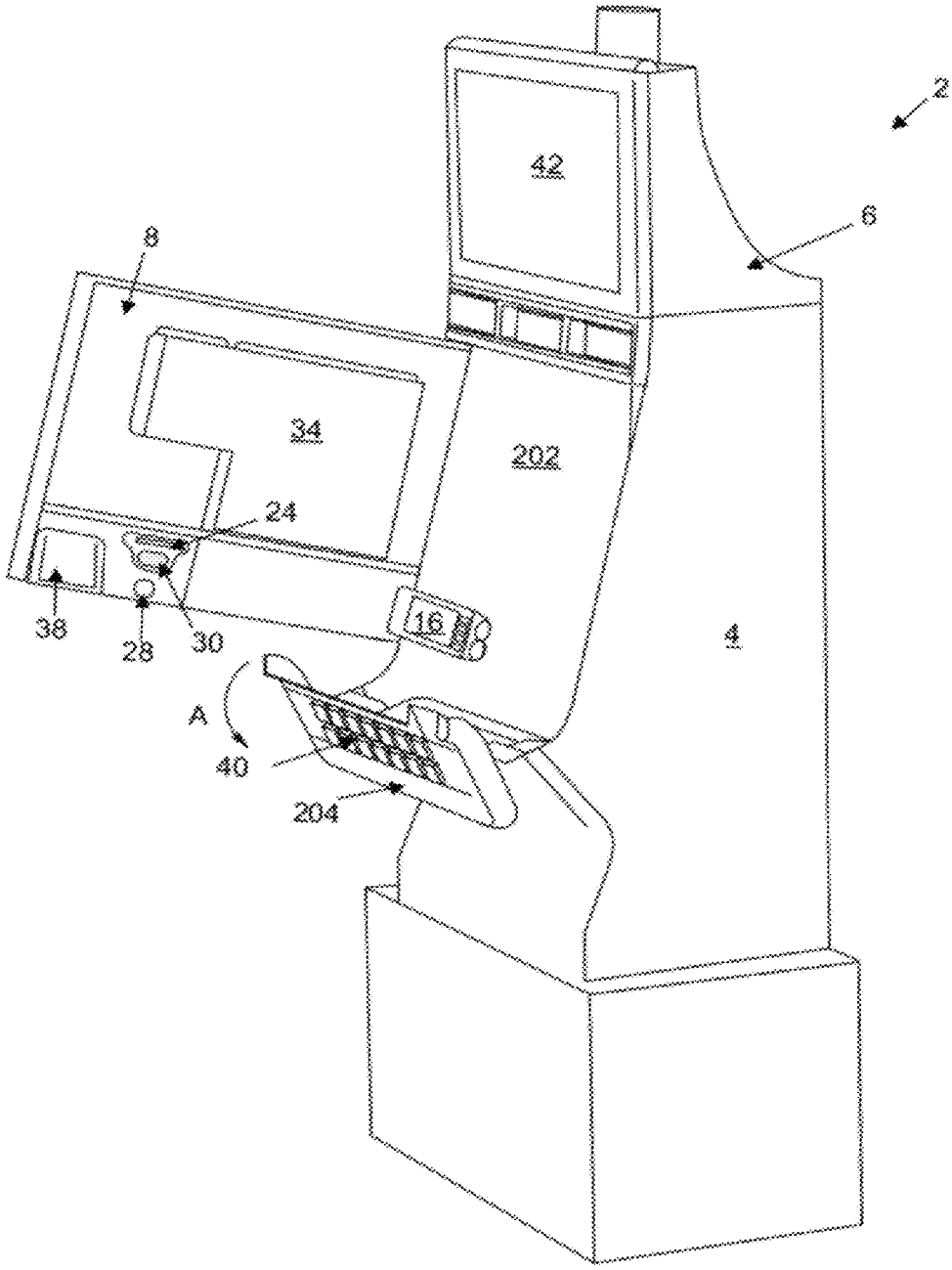
Figure 2D:
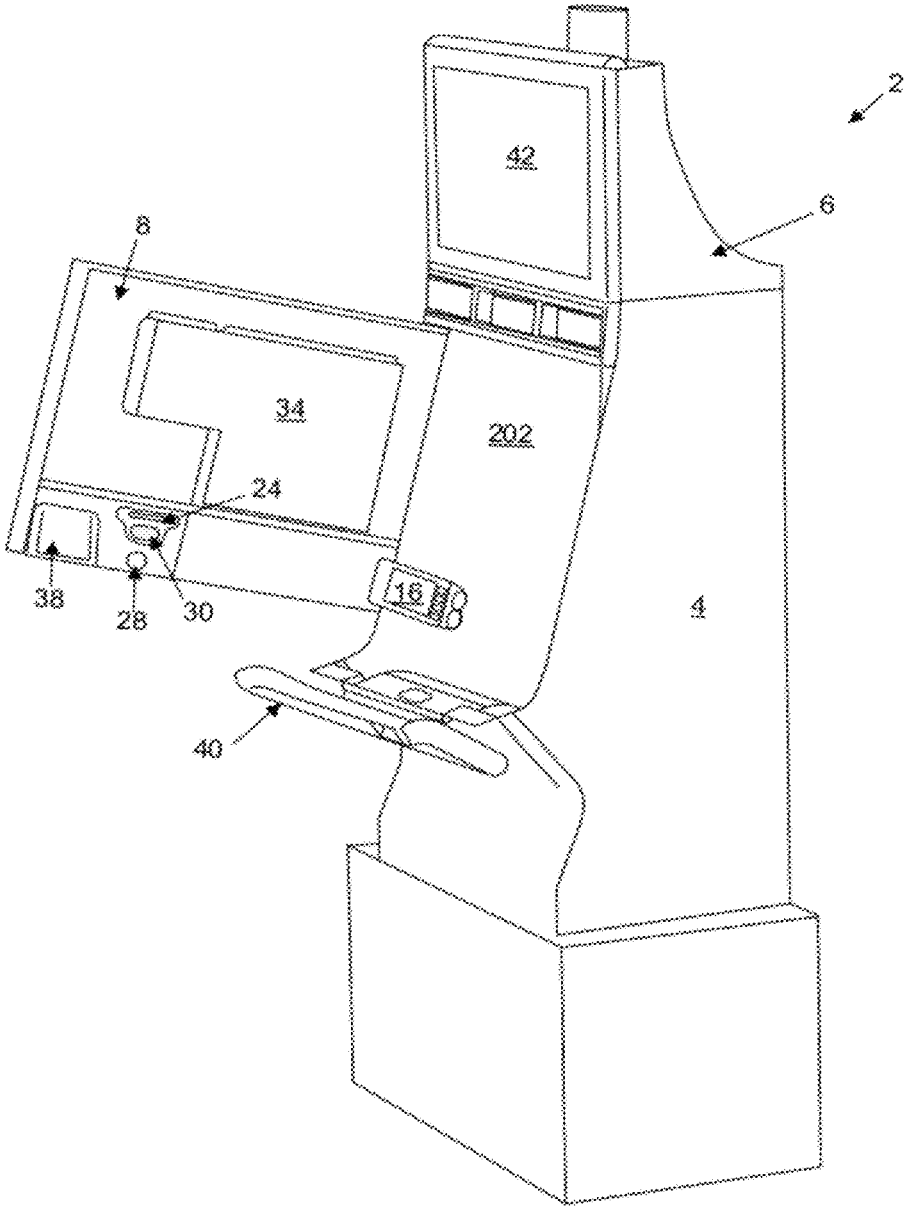

Referring now to FIG. 2B, a user may unlock a locking mechanism, described in detail below with reference to FIGS. 3A-3C, to release the button panel assembly 40. Once released, the button panel assembly 40 may be rotated in a direction away from the gaming machine 2 as illustrated by arrow A in FIG. 2C. This positions the button panel assembly 40 in an open position that allows for easy access to perform maintenance or service on the buttons, switches, and/or electromechanical connections the button panel assembly 40. No tools are necessary and integral machine components need not be removed with the button panel assembly. As further illustrated in FIG. 2D, the button panel assembly 40 may be configured to rotate downward through an angle greater than 180° to move the button panel assembly 40 out of the way to allow a user to easily access the interior portion 202.

Since the button panel assembly 40 is connected to the cabinet, it may be preassembled, tested, and installed quickly and easily. Furthermore, the button panel assembly 40 may be removed and replaced quickly if required.

Figure 3A:
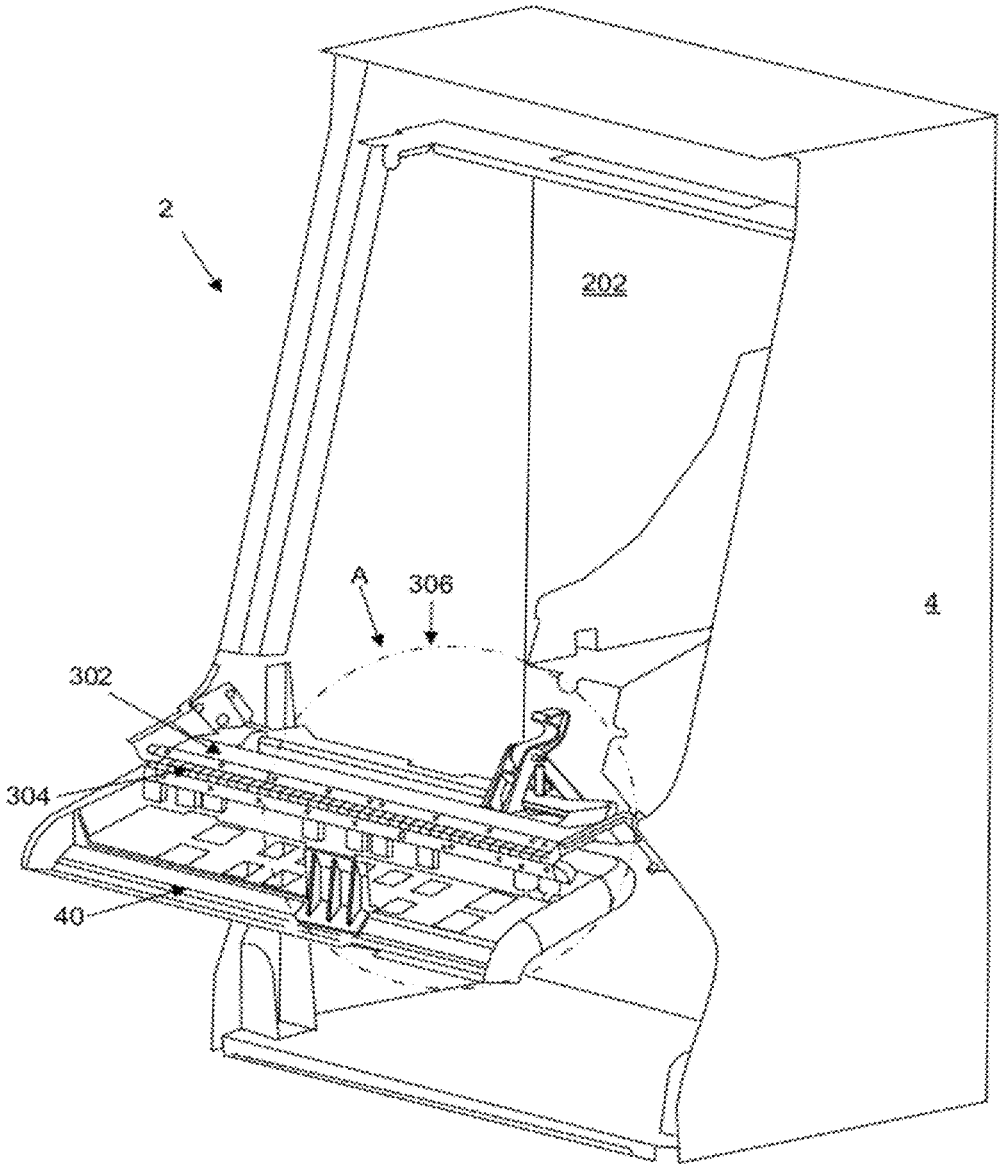
FIGS. 3A, 3B, and 3C illustrate an embodiment of a locking mechanism for the button panel assembly.
Figure 3B:
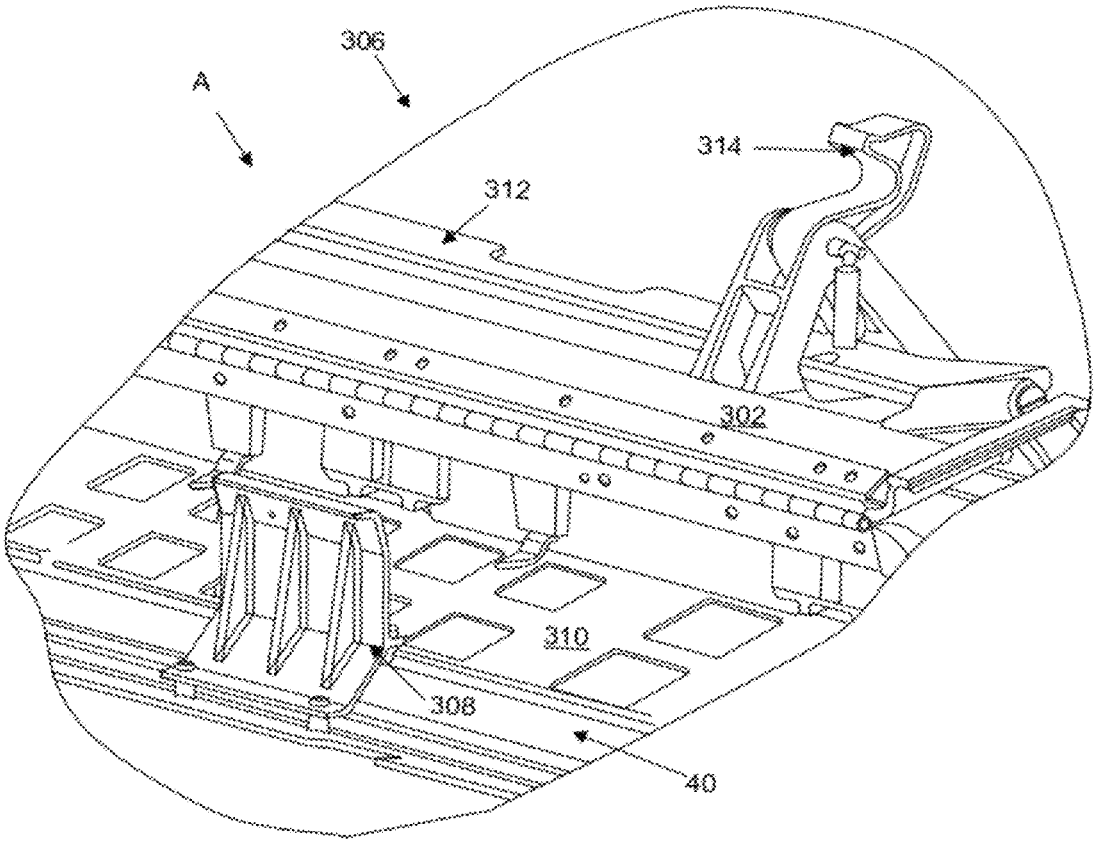
Figure 3C:
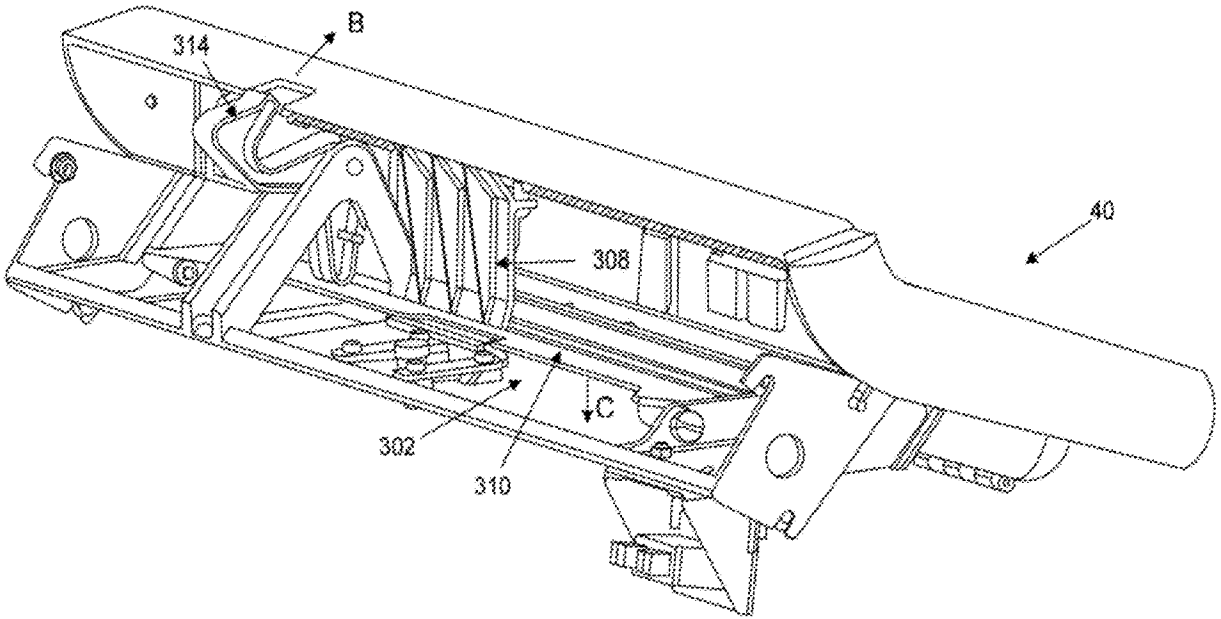

FIGS. 3A, 3B, and 3C illustrate an embodiment of a locking mechanism for the button panel assembly. Referring now to FIG. 3A, a support bracket 302 may be coupled to the front of the cabinet 4. The button panel assembly 40 may be coupled to the support bracket 302 with a connector 304. The connector may be any type of connector that will allow the button panel assembly 40 to rotate outwardly away from the gaming machine 2. For exemplary purposes only and not intended to be limiting, the connector 304 may be a hinge as illustrated in FIG. 3A. Additionally, although illustrated with the use of only one hinge, the number is not intended to be limiting as any number of connectors or hinges may be used as necessary. The button panel assembly may be configured to rotate along an axis of the connector to expose an interior portion 202 of the gaming machine 2.

The interior portion 202 of the gaming machine 2 may have at least one secure area. The gaming machine cabinet may have various components that a casino may want to control access thereto. Once the main door 8 is opened, there may be tiered access to various components within the cabinet 4. For exemplary purposes only and not intended to be limiting, a low security access area would allow a casino service person to access devices such as the power switch and to view the meters. A medium access area would allow the casino service person to access at least one of a coin hopper, cash box, paper holder, coin acceptor, or a printer. A high security access area may allow the casino service person to access devices such as the bill validator 30, network connections, master gaming controller, or other gaming machine electronics such as advanced video platform electronics.

To secure access to different areas of the gaming machine cabinet, additional security barriers may be positioned within the cabinet interior to prevent access to those areas. For example, the main door 8 may be used to secure the low security access areas. The medium security access area may be secured with the display 4 or the button panel assembly 40 as described above. Lastly, access to the high security areas may be secured with a security barrier (not shown). The security barrier may be another door, metal panel, or any other means to prevent unauthorized access. Additionally, the security barrier may be locked to the cabinet by any means known in the art. Thus, a plurality of security barriers may be used to control access to various areas within the interior portion 202.

A locking assembly, generally numbered 306, may secure the button panel assembly 40 to the support bracket 302. FIG. 3B illustrates a closer view of the locking assembly 306. The locking assembly 306 may have a secure latch 308 extending outwardly from the bottom 310 of the button panel assembly 40. A receiving bracket 312 may be coupled to the support bracket 302 to receive and engage the secure latch 308. A release latch 314 may be coupled to the receiving bracket 312 to raise the receiving bracket 312 when positioned in an unlocked position and lower the receiving bracket 312 when positioned in a locked position.

Referring now to FIG. 3C, when the button panel assembly 40 is rotated upward toward the gaming machine and positioned in a closed position, the secure latch 308 is received by the receiving bracket 310. To lock the button panel assembly to the support bracket 302, the release latch 314 may be moved in the direction of arrow B to a locked position. Moving release latch 314 to the locked position lowers the receiving bracket 310 in the direction of arrow C to secure and lock secure latch 308 to the support bracket 302.

In one embodiment to release the button panel assembly 40, the main door 8 may be in an open position to access the release latch 314. The release latch 314 may be moved in a direction opposite to arrow B or to an unlocked position to cause the receiving bracket 310 to raise and release the secure latch 308.

In another embodiment, the release latch 314 may be accessible without opening the main door 8. For exemplary purposes only and not intended to be limiting, access to the release latch 314 may be from a switch positioned exterior the cabinet 4. The switch may be any known mechanical, manual, or wireless switch. The main door 8 may be secured by the button panel assembly 34 such that access to open the main door may only be obtained by opening the button panel assembly 34. Once the button panel assembly 34 is in an open position, the door latch to open the main door 8 may be accessible to unlatch and move the main door 8 to an open position.

For additional security to lock the button panel assembly 34 to the cabinet 4, a lock may be coupled to the locking assembly 306. The lock may be any type of lock such as a key-actuated lock or a combination lock and may be positioned anywhere on the locking assembly 306 to lock the button panel assembly 34 to the cabinet 4. For example, the switch may also function as a lock such that access is allowed if the proper key or code is provided. This allows only authorized personnel to access the button panel assembly 34 and/or interior portion 202.

Although described with the embodiment above, those of ordinary skill in the art will now realize there may be many other ways to secure the button panel assembly to the cabinet and the embodiment is not intended to be limiting.

Figure 4:
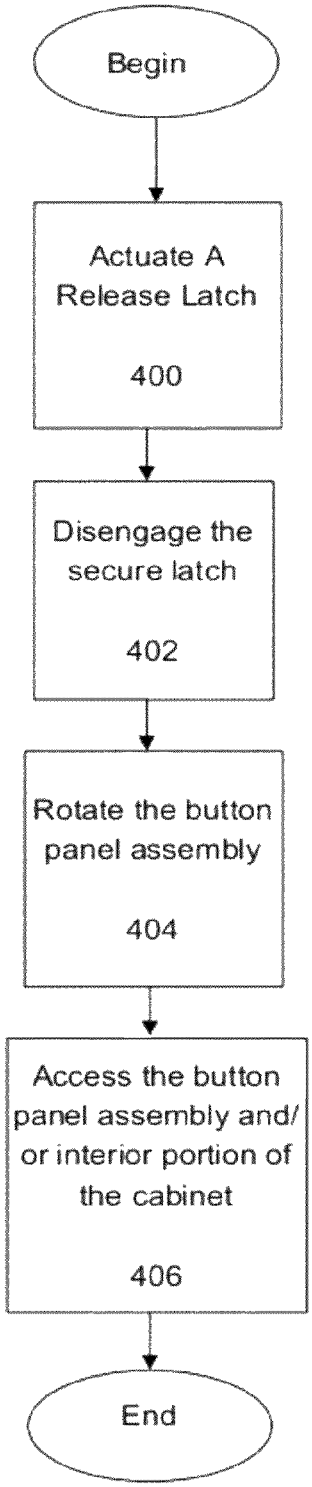
FIG. 4 is a flow chart illustrating an embodiment of a method for accessing an interior portion of a gaming machine.

FIG. 4 is a flow chart illustrating an embodiment of a method for accessing an interior portion of a gaming machine. A release latch may be actuated at 400 to an unlocked position to raise a receiving bracket. The receiving bracket may engage a secure latch coupled to the button panel assembly bottom. For additional security to lock the button panel assembly to the cabinet, a lock may be coupled to the locking assembly. The lock may be any type of lock such as a key-actuated lock or a combination lock and may be positioned anywhere on the locking assembly to lock the button panel assembly to the cabinet. For example, a lock may be coupled to the release latch. As such, a lock may first be unlocked before the release latch may be actuated to the unlocked position for access to the button panel assembly and/or interior portion.

In one embodiment to release the button panel assembly, the main door may be in an open position to access the release latch. In another embodiment, the release latch may be accessible without opening the main door. For exemplary purposes only and not intended to be limiting, access to the release latch may be from a switch positioned exterior the cabinet. The switch may be any known mechanical, manual, or wireless switch. In this embodiment, the main door may be secured by the button panel assembly such that access to open the main door may only be obtained by opening the button panel assembly. Once the button panel assembly is in an open position, the door latch to open the main door may be accessible to unlatch and move the main door to an open position.

The secure latch may be disengaged at 402 from the receiving bracket to release the button panel assembly. The button panel assembly may be used to perform other functions, in addition to having a plurality of player-input switches and a plurality of buttons. For exemplary purposes only and not intended to be limiting, the button panel assembly may have a wrist support to allow a user to support his wrists and rest upon. The wrist support may have a width that is substantially the same as a width of the front of the cabinet. The button panel assembly may also have a cup holder, a cigarette holder, and other similar devices.

The button panel assembly may be rotated downwardly at 404 away from the gaming machine for easy access to service or maintain the button panel assembly. A connector may be used to couple the button panel assembly to the support bracket. The connector may be any type of connector that will allow the button panel assembly to rotate outwardly away from the gaming machine. For exemplary purposes only and not intended to be limiting, the connector may be a hinge. Additionally, any number for connectors may be used as necessary. The button panel assembly may be configured to rotate along an axis of the connector to expose the button panel assembly and interior portion of the cabinet.

This positions the button panel assembly in an open position that allows for easy access to perform maintenance or service on the buttons, switches, and/or electromechanical connections of the button panel assembly. No tools are necessary and integral machine components need not be removed with the button panel assembly. Furthermore, the button panel assembly may be configured to rotate downward through an angle greater than 180° to move the button panel assembly out of the way to allow a user to easily access the interior portion of the gaming machine cabinet at 406.

While embodiments and applications have been shown and described, it would be apparent to those skilled in the art having the benefit of this disclosure that many more modifications than mentioned above are possible without departing from the inventive concepts herein. The invention, therefore, is not to be restricted except in the spirit of the appended claims.

What is claimed is:

1. A gaming machine, comprising:

a cabinet defining an interior area of the gaming machine;

a security barrier defining at least one secure area in the interior area of the gaming machine and having an open position and a closed position;

a support bracket coupled to the cabinet; and a modular user interface hingedly coupled to the support bracket with at least one hinged connector, the modular user interface substantially spanning a width of the cabinet and comprising a button panel and being configured to rotate about a hinge axis of the at least one hinged connector between a first position and a second position, a rear portion of the modular user interface: a) located behind a vertical plane passing through the axis when the modular user interface is in the first position and b)

located in front of the vertical plane when the modular user interface is in the second position, wherein a top surface of the button panel is exposed when the modular user interface is in the first position, wherein the interior area of the gaming machine is exposed when the modular user interface is in the second position, wherein the modular user interface remains hingedly coupled to the support bracket when in the first position and the second position, wherein a bottom surface of the button panel is exposed when the button panel is in the second position, wherein the security barrier is not movable from the closed position to the open position when the modular user interface is in the first position, and wherein the security barrier is movable from the closed position to the open position when the modular user interface is in the second position.

2. The gaming machine of claim 1, further comprising a releasable security barrier latch, wherein the releasable security barrier latch is configured to latch the security barrier when the security barrier is in the closed position.

3. The gaming machine of claim 2, wherein the releasable security barrier latch is configured to be inaccessible when the security barrier is in the closed position and the modular user interface is in the first position.

4. The gaming machine of claim 1, wherein the security barrier controls access to at least one secure area in the interior area of the gaming machine.

5. The gaming machine of claim 4, wherein the at least one secure area houses at least one of a bill validator, a printer, and a paper holder.

6. The gaming machine of claim 4, wherein the at least one secure area houses at least one of a master gaming controller, network connectivity hardware, and advanced video platform electronics.

7. The gaming machine of claim 4, further comprising a bill validator, wherein the bill validator is housed within the at least one secure area when the security barrier is in the closed position, and wherein the bill validator is attached to the security barrier.

8. The gaming machine of claim 1, wherein the security barrier is configured to rotate about an axis substantially orthogonal to the hinge axis.

9. The gaming machine of claim 1, wherein a width of a wrist support of the modular user interface is substantially the same as a width of the cabinet front.

10. The gaming machine of claim 1, wherein the button panel further comprises a plurality of player-input switches and a plurality of buttons.

11. The gaming machine of claim 1, wherein the modular user interface is configured to rotate downward through an angle greater than 180° as measured between the first position and the second position.

12. The gaming machine of claim 1, further comprising a locking assembly coupled to the modular user interface and the support bracket to secure the modular user interface to the support bracket, the locking assembly comprising:

a secure latch extending outwardly from a bottom of the modular user interface;

a bracket portion coupled to the support bracket to engage the secure latch; and a release latch coupled to the bracket portion, wherein the modular user interface is locked to the support bracket when the release latch is in a locked position.

13. The gaming machine of claim 12, wherein the bracket portion is configured to release the secure latch when the release latch is in an actuated position.

14. A method for accessing an interior area of a gaming machine, the gaming machine comprising:

a cabinet defining the interior area of the gaming machine a security barrier defining at least one secure area in the interior area of the gaming machine and having an open position and a closed position;

a support bracket coupled to the cabinet; and a modular user interface hingedly coupled to the support bracket with at least one hinged connector, the modular user interface substantially spanning a width of the cabinet and comprising a button panel and being configured to rotate about a hinge axis of the at least one hinged connector between a first position and a second position, a rear portion of the modular user interface: a) located behind a vertical plane passing through the axis when the modular user interface is in the first position and b) located in front of the vertical plane when the modular user interface is in the second position, wherein a top surface of the button panel is exposed when the modular user interface is in the first position, wherein the interior area of the gaming machine is exposed when the modular user interface is in the second position, wherein the modular user interface remains hingedly coupled to the support bracket when in the first position and the second position, wherein a bottom surface of the button panel is exposed when the button panel is in the second position, wherein the security barrier is not movable from the closed position to the open position when the modular user interface is in the first position, and wherein the security barrier is movable from the closed position to the open position when the modular user interface is in the second position, the method comprising:

rotating the modular user interface into the second position from the first position; and opening the security barrier after the rotating.

15. The method of claim 14, wherein the rotating step comprises rotating the modular user interface through an angle greater than 180°.

16. The method of claim 14, the gaming machine further comprising a releasable security barrier latch, wherein the releasable security barrier latch is configured to latch the security barrier when the security barrier is in the closed position, the method further comprising releasing the releasable security barrier latch.

17. The method of claim 16, wherein the releasable security barrier latch is configured to be inaccessible when the security barrier is in the closed position and the modular user interface is in the first position, the method further comprising:

rotating the modular user interface out of the first position; and releasing the releasable security barrier latch only after rotating the modular user interface out of the first position.

18. The method of claim 14, wherein the opening of the security barrier comprises rotating the security barrier about an axis substantially orthogonal to the hinge axis.

19. The method of claim 14, further comprising:

closing the security barrier after opening the security barrier; and rotating the modular user interface into the first position from the second position.

20. The method of claim 16, further comprising:

closing the security barrier after opening the security barrier;

latching the releasable security barrier latch; and rotating the modular user interface into the first position from the second position.

* * * * *